US005924968A

United States Patent [19]

Odenthal

[11] Patent Number: 5,924,968

[45] Date of Patent: Jul. 20, 1999

[54] BOX-ERECTING APPARATUS

[75] Inventor: Heinz F. Odenthal, Zülpich, Germany

[73] Assignee: OSTMA Maschinenbau GmbH, Zulpich, Germany

[21] Appl. No.: 08/951,040

[22] Filed: Oct. 15, 1997

[30] Foreign Application Priority Data

Jan. 23, 1997 [EP] European Pat. Off. ..... 97100996

[51] Int. Cl.[6] ..... B31B 1/78

[52] U.S. Cl. ..... 493/309; 493/52; 493/122; 493/123; 493/125; 493/126; 493/128; 493/143; 493/167

[58] Field of Search ..... 493/309, 51, 52, 493/122, 123, 312, 313, 314, 316, 125, 126, 127, 128, 131, 141, 143, 150, 167

[56] References Cited

U.S. PATENT DOCUMENTS

| | | | |
|---|---|---|---|
| 3,598,025 | 8/1971 | Cotton | 493/38 |
| 3,673,928 | 7/1972 | Striplin | 493/141 |
| 3,704,654 | 12/1972 | Bayer et al. | 493/167 |
| 4,283,190 | 8/1981 | Williams et al. | 493/131 |
| 4,340,380 | 7/1982 | Calvert | 493/312 |
| 4,578,054 | 3/1986 | Herrin | 493/131 |
| 4,581,005 | 4/1986 | Moen | 493/143 |
| 4,596,543 | 6/1986 | Reiser et al. | 493/131 |
| 4,746,321 | 5/1988 | Benedicenti | 493/125 |
| 5,385,526 | 1/1995 | Sigrist et al. | 493/126 |

FOREIGN PATENT DOCUMENTS 164 585 12/1985 European Pat. Off. .

*Primary Examiner*—James F. Coan
*Assistant Examiner*—Gene L. Kim
*Attorney, Agent, or Firm*—Herbert Dubno; Andrew Wilford

[57] ABSTRACT

An apparatus for erecting flat blanks into three-dimensional box parts has a machine frame, a bin on the frame holding a stack of the blanks with a lower surface of a lowermost blank largely exposed at a base of the stack, an erecting unit on the frame spaced downstream in a transport direction from the bin, and a conveyor on the frame. The conveyor has at least two spaced endless conveyor elements having upper stretches extending horizontally underneath the bin in the direction, respective suction boxes generally level with the upper stretches, and a drive for advancing the elements in the transport direction. An extractor on the frame underneath the bin includes a vertically displaceable vacuum-operated suction head engageable with the lower surface of the lowermost blank for pulling same out of the bin and setting it on the conveyor.

8 Claims, 3 Drawing Sheets

BOX-ERECTING APPARATUS

FIELD OF THE INVENTION

The present invention relates to an apparatus for erecting a box or the like. More particularly this invention concerns such a device which sets up a basically flat and two-dimensional blank into a three-dimensional box part.

BACKGROUND OF THE INVENTION

A standard apparatus for erecting box parts normally has a frame on which is carried a bin for holding a stack of the box blanks, an extractor for picking the blanks one at a time out of the bin, and a conveyor for delivering the blanks to an erecting unit which folds the blanks one at a time into the desired three-dimensional shape. Such a device works automatically and at high speed to produce a succession of set-up box parts, that is normally either bases or lids.

The extractor normally slides or pivots between a position engaging the top or bottom blank in the stack and a position setting the blank on the conveyor. The conveyor in turn has stops that catch on the blank deposited on it so that it is positively entrained.

Such a device is fairly complex mainly as a result of the path the blanks must follow on moving from the stack to the erecting unit. As a result it is fairly difficult to switch from a blank of one size and shape to one of a different size and shape, as such changeover entails reworking the movement of the extractor as well as the stops on the conveyor belt.

OBJECTS OF THE INVENTION

It is therefore an object of the present invention to provide an improved apparatus for erecting box parts.

Another object is the provision of such an improved apparatus for erecting box parts which overcomes the above-given disadvantages, that is which is relatively simple and which is easily adapted for blanks of different sizes and shapes.

SUMMARY OF THE INVENTION

An apparatus for erecting flat blanks into three-dimensional box parts has according to the invention a machine frame, a bin on the frame holding a stack of the blanks with a lower surface of a lowermost blank largely exposed at a base of the stack, an erecting unit on the frame spaced downstream in a transport direction from the bin, and a conveyor on the frame. The conveyor has at least two spaced endless conveyor elements having upper stretches extending horizontally underneath the bin in the direction, respective suction boxes generally level with the upper stretches, and a drive for advancing the elements in the transport direction. An extractor on the frame underneath the bin includes a vertically displaceable vacuum-operated suction head engageable with the lower surface of the lowermost blank for pulling same out of the bin and setting it on the conveyor.

The system of this invention exploits the fact that the blanks are elastically somewhat deformable so that they can be pulled straight down out of the bin without damaging them or entraining more than one blank. The suction head is lifted to engage the lower surface of the lowermost blank and then drops down after it has adhered to this surface, entraining the blank with it down out of the bin. Thus it is possible for the conveyor to be very close underneath the bin so that the extractor need only move through a very short vertical stroke to pull out a blank and deposit it on the conveyor. The result is a very compact machine with little possibility of the blank getting misaligned or dropped.

The extractor according to the invention further includes a drive for vertically displacing the suction head, suction cups on the head, and a controller for evacuating the suction cups during upward movement of the head and during downward movement from an uppermost position until a blank suctionally entrained by the head is resting on the conveyor and for thereupon venting the suction cups. This ensures positive placement of the blank on the conveyor.

In accordance with the invention the bin is formed by a plurality of vertically extending and horizontally adjustable guides, normally of L-shape with short horizontal legs that extend under the edges and against the lower face of the lowermost blank and long vertical legs that confine the stack. The frame is provided with a movable support carrying the guides and each suction box is elongated horizontally in the transport direction and each conveyor element is formed by a pair of thin endless strands flanking the respective box.

The erecting unit according to the invention includes a vertically displaceable erecting plate to one vertical side of a plane defined by the upper stretches; and a formatting tool that interfits with the erecting plate to the other vertical side of the plane. The plate can be underneath the plane and the tool above the plane when the machine is used to make box tops, and can be oppositely oriented to make box bottoms or bases.

Means is provided between the bin and the erecting unit for applying an adhesive to the blanks as they travel from the bin to the unit. In addition the frame carries a plurality of such bins in a row extending in the transport direction.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
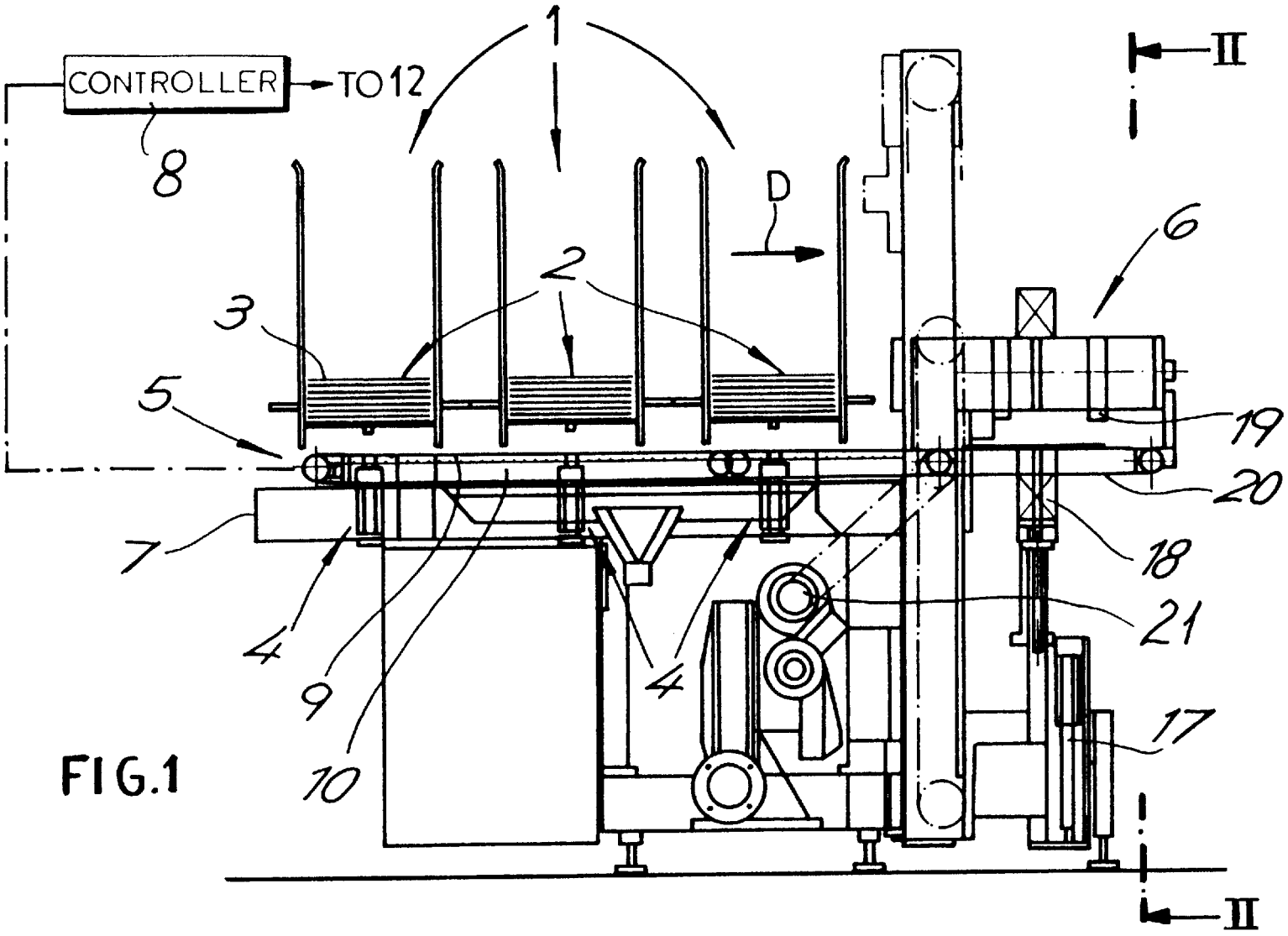
FIG. 1 is a partly diagrammatic side view of the apparatus of this invention.
Figure 2:
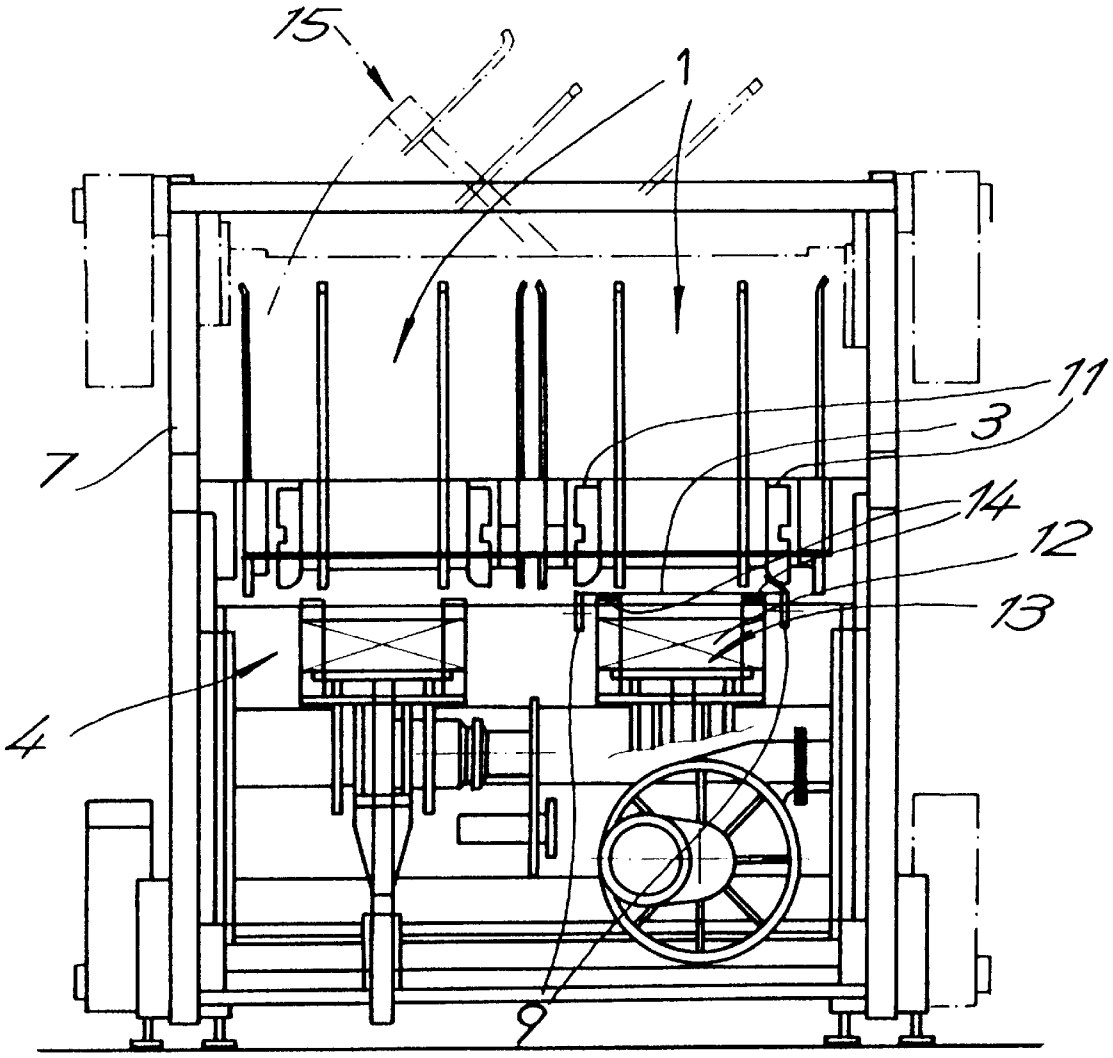
FIG. 2 is a section taken along line II—II of FIG. 1.
Figure 3:
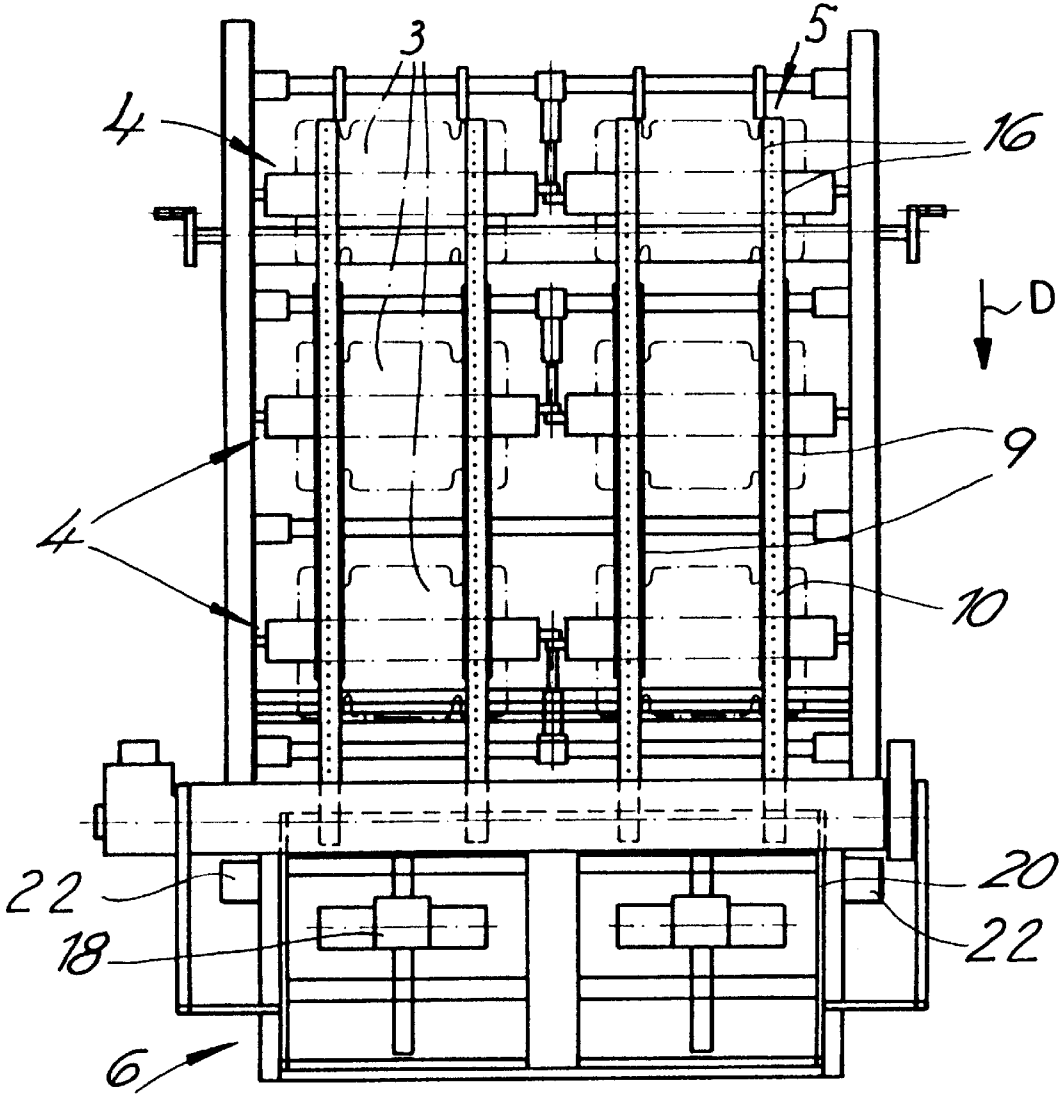
FIG. 3 is a top view of the apparatus.

As seen in FIGS. 1 through 3, an apparatus for erecting box parts has two rows each of three bins 1 each holding a stack 2 of basically flat box blanks 3. The bins 1 are each formed by several L-shaped guides 11 that engage the edges of the blanks 3 of the respective stack and that also engage under the edges of the lowermost blank 3 in each stack 2 to support the respective stack 2. A removable support 15 (FIG. 2) carries the guides 11 on a frame 7 of the machine so that they can be switched out against differently dimensioned bins for differently sized blanks 3.

Underneath each bin 1 is a respective takeoff or extractor device 4 and underneath each row of three bins 1 is a respective horizontally effective conveyor 5. Downstream from the bins 1 relative to a travel direction D defined by the conveyor 5 is an erecting unit 6.

The conveyor 5 comprises a plurality of longitudinally extending endless belts 9 each formed by a pair of cables or wires 16 flanking a respective suction box or strip 10. Thus the suction boxes 10 will hold the blanks 3 down on the belts 9 to ensure positive entrainment. A drive motor 21 advances the belts 9.

Each extractor 4 comprises a vertically displaceable vacuum device 12 having a head 13 provided with several suction cups 14. A controller 8 connected to the suction devices 12 (and to the conveyor 5 and the erector 6) evacuates the cups 14 as the head 13 is going up and while it is going down until it reaches a level with the blank 3 adhered to the head 13 engaging the belts 9, whereupon the cups 14 are vented to release the blanks 3 and allow them to be entrained by the conveyor 5.

The erector 6 has a plunger plate 18 vertically reciprocated by a drive 17 and cooperating with a format tool 19 to push the blanks 3 into the desired three-dimensional shape. The plunger plate 18 can be above the plane defined by the upper stretches of the conveyor 5 and the formatting tool 19 below it if desired, for instance to make oppositely open structures. Lateral holding conveyor belts 20 are provided that coact with the erecting tools 18 and 19. An applicator 22 is provided for applying glue to the blanks 3 before they are erected.

I claim:

1. An apparatus for erecting flat blanks into three-dimensional box parts, the apparatus comprising:

a machine frame;

a bin on the frame holding a stack of the blanks with a lower surface of a lowermost blank largely exposed at a base of the stack;

an erecting unit on the frame spaced downstream in a horizontal transport direction from the bin;

a conveyor on the frame including at least two pairs of endless conveyor strands having upper stretches extending horizontally underneath the bin in the transport direction and spaced apart transversely of the transport direction, respective suction boxes elongated in the transport direction, generally level with the upper stretches, and lying between the strands of each pair of conveyor strands, and drive means for advancing the upper stretches in the transport direction; and extractor means on the frame underneath the bin and including a vertically displaceable vacuum-operated suction head engageable with the lower surface of the lowermost blank for pulling the lowermost blank out of the bin and setting it on the conveyor.

2. The blank-erecting apparatus defined in claim 1 wherein the extractor means further includes:

a drive for vertically displacing the suction head;

suction cups on the head; and control means for evacuating the suction cups during upward movement of the head and during downward movement from an uppermost position until a blank suctionally entrained by the head is resting on the conveyor and for thereupon venting the suction cups.

3. The blank-erecting apparatus defined in claim 1 wherein the bin is formed by a plurality of vertically extending and horizontally adjustable guides.

4. The blank-erecting apparatus defined in claim 3 wherein the frame is provided with a movable support carrying the guides.

5. The blank-erecting apparatus defined in claim 1 wherein the erecting unit includes a vertically displaceable erecting plate to one vertical side of a plane defined by the upper stretches; and a formatting tool that interfits with the erecting plate to the other vertical side of the plane.

6. The blank-erecting apparatus defined in claim 5 wherein the plate is underneath the plane and the tool is above the plane.

7. The blank-erecting apparatus defined in claim 1, further comprising means between the bin and the erecting unit for applying an adhesive to the blanks as they travel from the bin to the erecting unit.

8. The blank-erecting apparatus defined in claim 1 wherein the frame carries a plurality of such bins in a row extending in the transport direction.

* * * * *